US009717973B2

(12) United States Patent
Elpers et al.

(10) Patent No.: US 9,717,973 B2
(45) Date of Patent: Aug. 1, 2017

(54) BASKETBALL STOPPING WALL

(71) Applicant: Indian Industries, Inc., Evansville, IN (US)

(72) Inventors: Philip Elpers, Evansville, IN (US); Michael Guerzini, Newburgh, IN (US); Andrew Hughes, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 267 days.

(21) Appl. No.: 13/911,728

(22) Filed: Jun. 6, 2013

(65) Prior Publication Data

US 2013/0331208 A1 Dec. 12, 2013

Related U.S. Application Data

(60) Provisional application No. 61/656,602, filed on Jun. 7, 2012.

(51) Int. Cl.

| | |
|---|---|
| ***A63B 69/00*** | (2006.01) |
| ***A63B 71/02*** | (2006.01) |
| *A63B 63/08* | (2006.01) |

(52) U.S. Cl.

CPC ..... *A63B 71/022* (2013.01); *A63B 63/083* (2013.01); *A63B 2210/50* (2013.01); *A63B 2225/09* (2013.01)

(58) Field of Classification Search

CPC ..... A63B 71/022
USPC ..... 473/421, 431–435, 447, 472, 476–484; 135/90; 160/84.07
See application file for complete search history.

(56) References Cited

U.S. PATENT DOCUMENTS

| | | | | |
|---|---|---|---|---|
| 285,530 | A * | 9/1883 | Verbeck | A45B 3/00 135/66 |
| 823,096 | A * | 6/1906 | Armstrong | E04F 10/10 160/134 |
| 3,386,106 | A * | 6/1968 | Clemens | A47H 21/00 160/84.07 |
| 4,072,295 | A | 2/1978 | Roberts | |
| 4,657,250 | A * | 4/1987 | Newland et al. | 473/432 |
| 4,667,957 | A | 5/1987 | Joseph | |
| 4,745,960 | A * | 5/1988 | Karp | G08G 1/095 160/84.07 |
| 4,762,319 | A | 8/1988 | Krumholz | |
| 4,838,549 | A | 6/1989 | Woodall | |
| 5,016,875 | A | 5/1991 | Joseph | |
| 5,129,648 | A | 7/1992 | Sweeney et al. | |
| 5,165,680 | A | 11/1992 | Cass | |
| 5,171,009 | A | 12/1992 | Filewich et al. | |

(Continued)

*Primary Examiner* — Melba Bumgarner
*Assistant Examiner* — Laura L Davison
(74) *Attorney, Agent, or Firm* — Woodard, Emhardt, Moriarty, McNett & Henry LLP

(57) ABSTRACT

The present disclosure provides a basketball stopping apparatus arranged for attachment to a basketball goal assembly. In some embodiments, the basketball stopping apparatus is configurable between a first position and a second position, the first position being arranged for the deflection of errant basketball shots and the second position being arranged for storage of the basketball stopping apparatus before and/or after use. Additionally, some embodiments include a wall coupled to base arms that are pivotably mounted to a bottom end of the basketball goal assembly.

17 Claims, 14 Drawing Sheets

(56) References Cited

U.S. PATENT DOCUMENTS

| | | | | | |
|---|---|---|---|---|---|
| 5,222,261 | A | * | 6/1993 | Tooze | A47K 3/38 160/84.07 |
| 5,402,999 | A | | 4/1995 | Keehn, Sr. | |
| D359,161 | S | * | 6/1995 | Byrne | D3/5 |
| 5,540,428 | A | | 7/1996 | Joseph | |
| 5,690,339 | A | * | 11/1997 | Chen | 273/400 |
| 5,730,666 | A | | 3/1998 | Hudson | |
| 5,785,616 | A | | 7/1998 | Dodge | |
| 5,913,778 | A | * | 6/1999 | Hying | E02D 27/42 248/156 |
| 5,971,873 | A | * | 10/1999 | Balducci | 473/433 |
| 6,056,652 | A | | 5/2000 | Lees et al. | |
| 6,074,313 | A | | 6/2000 | Pearson | |
| 6,224,503 | B1 | | 5/2001 | Joseph | |
| 6,267,696 | B1 | | 7/2001 | Mabe et al. | |
| 6,416,431 | B1 | | 7/2002 | Keehn, Sr. et al. | |
| 6,595,877 | B2 | * | 7/2003 | Pearson | 473/433 |
| 6,705,381 | B2 | * | 3/2004 | Huang | B60J 1/2091 160/370.22 |
| 6,746,348 | B2 | * | 6/2004 | Barnes et al. | 473/433 |
| 6,926,060 | B2 | * | 8/2005 | Mark | A63B 71/022 135/133 |
| 2001/0055999 | A1 | | 12/2001 | Bush | |
| 2002/0025865 | A1 | | 2/2002 | Pearson | |

* cited by examiner

BASKETBALL STOPPING WALL

CROSS-REFERENCE TO RELATED APPLICATIONS

This application claims the benefit of U.S. Provisional Application No. 61/656,602, filed Jun. 7, 2012, which is hereby incorporated by reference in its entirety.

FIELD OF THE INVENTION

The present disclosure pertains generally to accessories for use in combination with a basketball goal assembly. More particularly, the present invention pertains to devices capable of stopping errant basketball shots from traveling into an area behind and/or adjacent to a basketball goal assembly.

BACKGROUND

In the sport of basketball a player can shoot a basketball towards a basketball goal from an infinite number of possible locations. Each shot is typically aimed at either a horizontally-oriented rim of the basketball goal or a vertically-oriented backboard that is adjacent the rim and useful for banking shots into the rim.

A skilled player can shoot the basketball such that the basketball hits the targeted backboard and/or enters the rim at some point along its trajectory. However, during play a basketball player may shoot a basketball in such a manner that the ball misses its targeted rim or backboard and travels into the area behind and/or adjacent to the basketball goal. Basketball shots that continue past the backboard may become cumbersome and time-consuming to retrieve, thus interrupting play. Additionally, errant shots can cause damage to various valuables or surroundings and/or risk injury or harm to small children who pursue the errantly shot ball.

In light of the burdensome and harmful effects of errant basketball shots, a number of apparatuses have been developed in an effort to help stop errant basketball from traveling into the area behind the basketball goal. Unfortunately, many of the existing collection apparatuses interfere with one's ability to move around the basketball goal assembly during periods of non-use. Additionally, many of the existing collection apparatuses are unsightly, having large and/or protruding portions that substantially increase the space that the basketball goal assembly occupies. During windy conditions, increased forces may be exerted on these large and/or protruding portions and are transmitted to the basketball goal assembly, thus increasing the likelihood of damage to the collection apparatus and/or the basketball goal assembly. Additionally, many of the collection apparatuses may be difficult to set-up and/or take-down before and/or after periods of use.

Thus new devices for minimizing errant basketball shots are desired.

SUMMARY

In some aspects, the present disclosure provides an apparatus for stopping an errantly shot basketball, the apparatus comprising a flexible wall, a left base arm, and a right base arm. The flexible wall is attachable to a post of a basketball goal comprises left and right wall portions having upper edges securable to a top end region of the post. The left base arm is secured to a bottom edge of the left wall portion and arranged to pivotally connect to a bottom end region of the post. Similarly, the right base arm is secured to a bottom edge of the right wall portion and arranged to pivotally connect to a bottom end region of the post. When connected to the bottom end region of the post, the left and right base arms are pivotable between a vertical configuration and a horizontal configuration. In the vertical configuration the left and right base arms gather the bottom edges of the left and right wall portions of the flexible wall near the post; and in the horizontal configuration the left and right base arms spread the left and right wall portions of the flexible wall laterally away from the bottom end region of the post so as to spread the flexible wall portions into an open arrangement. In some instances, a length of the left base arm is arranged along a length of the bottom edge of the left wall portion, and a length of the right base arm is arranged along a length of the bottom edge of the right wall portion.

In certain aspects, the present disclosure provides an apparatus for stopping an errantly shot basketball, the apparatus comprising a flexible wall attachable to a basketball goal, the flexible wall comprising left and right wall portions each having a bottom portion that is securable to a base positioned on a support surface and an upper portion that is securable to an elevated portion of the basketball goal. A left base arm is secured to a bottom edge of the left wall portion and arranged to pivotally connect to the base, and a right base arm is secured to a bottom edge of the right wall portion and arranged to pivotally connect to the base. When connected to the base, the left and right base arms are pivotable between a vertical configuration and a horizontal configuration. In the vertical configuration the left and right base arms gather the bottom edges of the left and right wall portions of the flexible wall above the base, and in the horizontal configuration the left and right base arms spread the left and right wall portions of the flexible wall laterally away from the base so as to spread the flexible wall portions into an open arrangement behind a backboard of the basketball goal. In some instances, the apparatus also comprises a left intermediate arm secured to the left wall portion and a right intermediate arm secured to the right wall portion, wherein the left and right intermediate arms each have a length and spread the secured wall portion along the length.

In some instances, the present disclosure provides an apparatus for stopping an errantly shot basketball, comprising a flexible wall attachable to a basketball goal, the flexible wall comprising left and right wall portions each having a bottom portion that is securable to a base positioned on a support surface and an upper portion that is securable to an elevated portion of the basketball goal, left and right base arms and left and right intermediate arms. The left base arm is secured to a bottom edge of the left wall portion and arranged to pivotally connect to the base, and the right base arm is secured to a bottom edge of the right wall portion and arranged to pivotally connect to the base. The left intermediate arm is secured to the left wall portion and the right intermediate arm secured to the right wall portion, and the left and right intermediate arms each have a base end, an outer end, and a length and spread the secured wall portion along their length. The base ends of the left and right intermediate arms are adjacent to the base and the outer ends are adjacent a peripheral edge of the respective flexible wall. In some embodiments, it is preferred that the left and right base arms are rigid along their length and the left and right intermediate arms are flexibly resilient along their length.

Further forms, objects, features, aspects, benefits, advantages, and embodiments of the present invention will become apparent from a detailed description and drawings provided herewith.

DESCRIPTION OF THE ILLUSTRATED EMBODIMENTS

Figure 1:
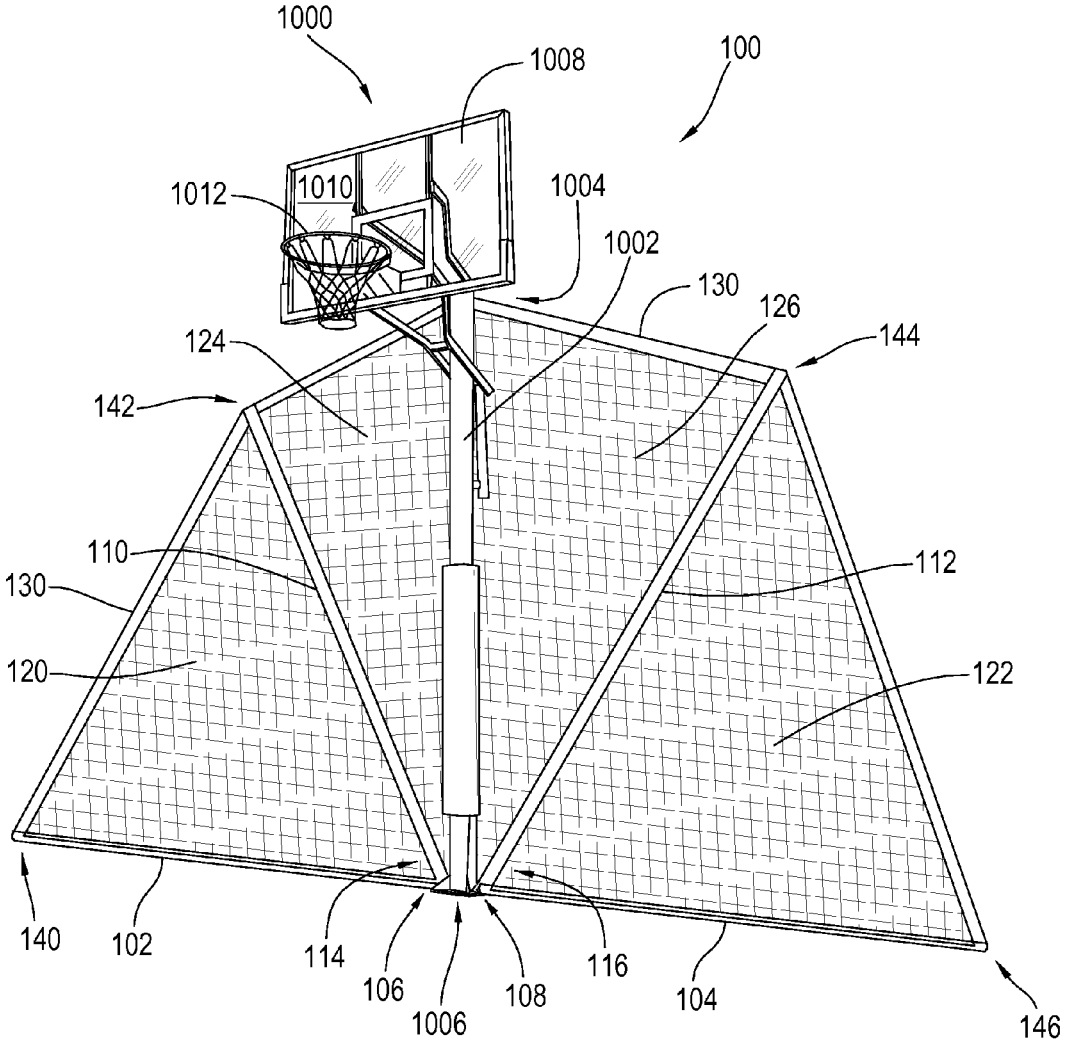
FIG. 1 is a perspective view of one embodiment of the present disclosure.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

In some aspects, the present disclosure provides a basketball stopping apparatus for attachment to a basketball goal assembly. The basketball stopping apparatus comprises a wall that is spread into an open configuration by one or more arms. In some embodiments, at least one of the arms is pivotably coupled to the base of the basketball goal assembly, and spreads the wall along a horizontal direction. Additionally, some embodiments have a perimeter member that extends along a periphery of the wall. The perimeter member may couple one or more arms of the basketball stopping apparatus. Some embodiments have the perimeter member coupled to a top portion of the post of a basketball goal assembly and extending in an outward and downward direction, towards an end of at least one of the arms.

In other aspects, the present disclosure provides a basketball stopping apparatus for attachment to a basketball goal assembly, comprising: a wall spread into an open configuration by a base arm and an intermediate arm. In some instances, the base arm is pivotably coupled to the base of the basketball goal assembly, such as the bottom of the post. In some embodiments, the intermediate arm has one or more free-floating ends. A perimeter member may extend along a periphery of the wall and couple one or more arms of the basketball stopping apparatus. In some embodiments, the base arms and the intermediate arms have different properties. For example, the base arms may be rigid and the intermediate arms may be flexible. Similarly, the base arms and the intermediate arms may be constructed from different materials.

In some instances, the present disclosure provides a basketball stopping apparatus for attachment to a basketball goal assembly, comprising a wall and one or more arms arranged to hold the wall into a spread configuration. In some embodiments, the basketball goal assembly is configurable between a spread, playing configuration and a collapsed, stored configuration.

The disclosed embodiments and variations thereof may be used to stop or block basketballs. In some instances, a basketball stopping wall may be used to divert an errantly shot basketball from entering into the area located behind the basketball goal assembly. For example, an errantly shot basketball following a trajectory into an area adjacent to and/or behind the basketball goal assembly may contact a wall of the basketball stopping apparatus, thus preventing the basketball from traveling into the area adjacent to and/or behind the basketball goal assembly. In some embodiments, an errantly shot basketball may contact a wall and be directed in a downward direction towards an area generally beneath the backboard. In other embodiments, the basketball may be deflected in a direction back onto the basketball court and/or towards a player.

An embodiment of the invention will be disclosed in detail below with reference to a basketball goal assembly 1000. Specifically, various aspects of the disclosed embodiments will be discussed with reference to a basketball goal assembly 1000 having a support such as a post 1002 with a top end 1004 and a bottom end 1006. In some cases, the backboard 1008 having a front surface 1010 and a rim assembly 1012 attached thereto is coupled to the top end 1004 of the post 1002, the post 1002 is often perpendicular to the surface supporting the basketball goal assembly 1000. For example, some basketball goal assemblies have the post 1002 entering a hole in the ground or being bolted to the ground. Other basketball goal assemblies have the post 1002 being supported by a weighted base, such as a sand or water filled container. Sometimes the weighted bases are portable and may have wheels attached thereto.

Many basketball goal assemblies have slanted and/or curvilinear posts and some basketball goal assemblies have no post at all. For example, some basketball goal assemblies are mounted on a wall and/or are suspended from a ceiling. As will be apparent to one of ordinary skill in the art, different arrangements of basketball goal assemblies are contemplated by the inventor(s) of the present disclosure and the embodiments illustrated and described in the present disclosure may be modified for the various arrangements of basketball goal assemblies without departure from the invention.

FIG. 1 illustrates one embodiment of a basketball stopping wall 100 suitable for stopping errant basketball shots. Generally, the basketball stopping wall 100 comprises a wall that is spread into an open configuration by one or more arms. In some instances, the basketball stopping wall 100 comprises two halves, each with one or more spreading arms and a wall portion. As will be appreciated, the wall may be made of a spreadable material suitable for preventing a basketball from passing therethrough, such as a net, screen, mesh, or sheet material. Alternatively or additionally, the wall may comprise a plurality of elongate elements, such as cables, or chains, that extend individually across the area of the wall and/or have portions that intersect with other elongate elements, such as in a woven or overlapping pattern, to name just a few non-limiting examples.

In some instances the wall is inelastic and is made from a material such as plastic. In other instances, the wall has elastic and/or flexible resilient portions so as to aid in stopping or blocking the errantly-shot ball. For example, portions of the wall may be made from an elastomer such as rubber and/or have elastic members such as springs, to name a few non-limiting examples.

As illustrated in FIG. 1, the wall portions of the basketball stopping wall 100 are spread open by a pair of base arms 102 and 104 that, when deployed, can lie on a support surface such as the ground or a floor and extend generally in a horizontal direction away from the bottom end 1006 of the post 1002 of the basketball goal assembly 1000. In some embodiments, base arms 102 and 104 extend in directions that are substantially parallel to the surface each lies upon. However, in some instances, base arms 102, 104 can be suspended above the ground or floor by portions of the wall, with the weight of base arms 102 and 104 pulling portions of the wall in a downward direction.

In some embodiments, the base arms 102 and 104 extend in directions substantially opposite of one another. For example, base arm 102 may extend to the left of the post 1002 and base arm 104 may extend to the right of the post 1002 from the illustrated perspective, with both base arm 102 and base arm 104 typically residing in the same plane. In some embodiments the base arms 102 and 104 extend in directions that are non-parallel to one another. Additionally or alternatively, base arms 102 and/or 104 may extend in directions that are substantially parallel to the supporting surface, e.g., the ground or floor.

In many instances, portions of the flexible wall are generally parallel with the backboard of the basketball goal. However, in some embodiments, the wall may be angled with respect to the backboard 1008. For example, one or more of the base arms 102 and/or 104 may extend in a direction that is non-parallel to a plane defined by the front surface 1010 of the backboard 1008 and therefore spread the wall in that direction. Specifically, one or more of base arms 102 and/or 104 may be angled towards or away from the basketball court. For example, base arms 102 and 104 may extend away from the area located behind the basketball goal assembly 1000, so as to form a V arrangement in a plane that generally is parallel to the ground or floor. In some instances, the one or more of base arms 102 and/or 104 extend in a direction that is perpendicular to the direction from which a player is practicing shooting a basketball. So, for example, if a player is shooting a basketball from a position to the right of the basketball goal 1000, such as the perspective shown in FIG. 1, the base arm 102 may be angled towards the basketball court and/or the base arm 104 may be angled away from the basketball court and therefore present the wall in a similar fashion. Advantageously, this type of arrangement can position a wall portion of the basketball stopping wall 100 in an orientation that faces the shooting player, such that the wall will stop, redirect and/or guide an errantly shot ball. In some instances, the wall is arranged to guide an errantly shot ball back towards a player.

In some embodiments, base ends 106 and 108 of the base arms 102 and 104 are pivotably coupled to the bottom end 1006 of the post 1002 so as to allow the base arms 102 and 104 to be vertically pivoted. For example, the base arms 102 and 104 may be rotated from their generally horizontal position into an upright position where the base arms 102 and 104 are generally perpendicular to the support surface and parallel to the post 1002 of the basketball goal 1000. Additionally, the wall portions may be collapsed and/or gathered at the same time. Such an arrangement decreases the amount of space the basketball stopping wall 100 occupies during periods of nonuse and thus allows for one to more easily maneuver around the basketball goal assembly 1000. Alternatively, and/or additionally, the base arms 102 and 104 may be pivotably coupled in an arrangement capable of horizontal rotation. For example, the base arms 102 and 104 may be horizontally rotated into an orientation that is non-parallel to the plane defined by the front surface 1010 of the backboard 1008. As discussed above, one or more of the base arms 102 and/or 104 may angle towards or away from the basketball court (i.e., the area in front of the basketball goal assembly 1000) to present the wall in a desired orientation to stop or block errant shots. For basketball goals that do not have a post, the base arms 102 and 104 may be pivotably coupled to a base member positioned on a supporting surface, such as the ground or the floor.

In some embodiments the basketball stopping wall 100 has intermediate arms 110 and 112 that spread portions of the wall between the base arms 102 and 104 and the post 1002. For example, intermediate arms 110 and 112 may be arranged in an angled relationship with respect to the post 1002 and/or the base arms 102 and 104. The intermediate arms 110 and 112 may have base ends 114 and 116 positioned at and/or near the base 1006 of the basketball goal assembly 1000 and extend from the base ends 114 and 116 in an upward direction away from the post 1002. For example, base end 114 may be positioned adjacent to but spaced apart from base 1006 with intermediate arm 110 extending away from base 1006 and having an outer end 142 positioned adjacent a periphery of a wall portion. Similar to the arrangement of the base arms 102 and 104, the intermediate arms 110 and 112 may extend in directions that lie in the same plane or in different planes. In some instances, one or more of the intermediate arms 110 and/or 112 lie in the same plane as one or more of the base arms 102 and/or 104. In many embodiments, the ends of the intermediate arms 110 and 112 are coupled to the wall so as to spread the wall along the length of the intermediate arm. In some embodiments, base ends 114 and 116 are free-floating and are not coupled to the post 1002.

As will be appreciated by one of ordinary skill in the art, the base arms 102 and 104 and intermediate arms 110 and 112 may be various shapes and sizes, and each arm may be formed by one or more members. For example, base arms 102, 104 and/or intermediate arms 110, 112 can comprise telescoping members arranged to adjust the length of the arms. Additionally, fewer or more base arms 102 and 104 and/or intermediate arms 110 and 112 than those described above and illustrated with respect to FIG. 1 may be used. For example, two intermediate arms may be used on each half of the ball stopping wall, so as to have a total of four intermediate arms. Alternatively an embodiment may include zero intermediate arms.

The base arms 102 and 104 and the intermediate arms 110 and 112 may be constructed from any suitable material(s) apparent to one of ordinary skill in the art and may have different properties and/or be made of the same or different materials. In some embodiments, the base arms 102 and 104 are made of a rigid material and the intermediate arms 110 and 112 are made from a resilient material or vice versa. For example, the base arms 102 and 104 may be made of a metal such as steel or aluminum while the intermediate arms 110 and 112 are made of plastic, fiberglass, or a composite, to name a few non-limiting examples.

The wall of the ball stopping wall 100 may have multiple portions and may be made of a single wall piece or of multiple wall pieces. For example, as illustrated in FIG. 1, the wall may have two wall portions, one for each half of the ball stopping wall 100. As mentioned above, the base arms 102 and 104 and the intermediate arms 110 and 112 spread portions of the wall. For example, the base arms 102 and 104 and intermediate arms 110 and 112 may spread outer wall portions 120 and 122 horizontally and vertically. In some instances, portions of the wall may be coupled to portions of the basketball goal assembly 1000, such as the post 1002 and/or the backboard 1008.

In basketball goal arrangements that do not have a post 1002 supported by the ground (e.g., backboard assemblies mounted on a wall and/or from a ceiling), various modifications may be made to the embodiments described in the present disclosure. For example, the wall may be coupled to the backboard assembly, its supporting structure, a ceiling, and/or a wall adjacent the backboard assembly instead of the post 1002 described above. In some embodiments, the basketball stopping wall further comprises a vertical arm extending in a vertical direction generally towards the backboard assembly. The vertical arm may be supported on the bottom end by a stand, and portions of the wall may be attached to the top end of the vertical arm so as to spread the wall vertically towards the backboard assembly. In any of the embodiments, the arms of the basketball stopping wall may be pivotably coupled to a stand or base positioned on the ground or may be coupled to one another. For example, the base arms 102 and 104 can be pivotably coupled to a vertical arm.

A perimeter member 130 may extend along a perimeter of the wall portions 120, 122, 124, and/or 126. In some embodiments, the perimeter member 130 extends from the outer ends 140, 142, 144, and/or 146 of the base arms 102 and/or 104 and/or the intermediate arms 110 and/or 112. Additionally, the perimeter member 130 may be coupled to a portion of the basketball goal assembly 1000, such as the post 1002. The perimeter member 130 can be a rigid member, such as a bar or bar sections, and/or it may be a flexible resilient member, such as a cord and/or a chain or sections thereof, just to name a few examples. The perimeter member 130 may also have straight and/or curved sections.

In some instances, as illustrated in FIG. 1, the perimeter member and wall portions form a semi-octagonal shape, corresponding to the number of wall portions defined by the arms; however, as will be appreciated by one of ordinary skill in the art, a variety of shapes can be formed by the perimeter member and wall. Alternatively, the perimeter member 130 may have multiple sections extending along the periphery of the wall portions 120, 122, 124, and/or 126.

When in an expanded, ball-diverting configuration, such as the one illustrated in FIG. 1, the basketball stopping wall 100 may form a substantially planer arrangement adjacent to and often slightly behind the backboard 1008. The base arms 102 and 104 spread the outer wall portions 120 and 122 and the perimeter member 130 horizontally away from the post 1002 and in a downward direction, such as by the weight of the base arms 102 and 104 pulling down on the outer wall portions 120 and 122 and the perimeter member 130. Additionally, the intermediate arms 110 and 112 spread the wall portions 120, 122, 124, and/or 126 along the length of the intermediate arms 110 and 112. The arms preferably spread the wall to a configuration having a maximum wall area, thus increasing the likelihood that the wall will be positioned in the trajectory of an errantly shot basketball.

When in a compact, stored configuration, the base arms 102 and/or 104 and/or the intermediate arms 110 and/or 112 can be positioned vertically, for example alongside the post 1002 of the basketball goal assembly 1000. Similarly, the wall portions 120, 122, 124, and/or 126 are gathered or collapsed to be positioned adjacent to the base arms 102 and 104 and/or intermediate arms 110 and 112. The base arms 102 and/or 104, the intermediate arms 110 and/or 112, and/or wall portions 120, 122, 124, and/or 126 may be secured to one another and/or a portion of the basketball goal assembly 1000, such as the post 1002, by any appropriate fastener apparent to one of ordinary skill in the art by a such as a hook, a strap, a clamp, and/or an adhesive member, to name a few non-limiting examples. In embodiments without a post 1002, the ball stopping wall may be collapsed into a vertical arrangement and coupled to a portion of the basketball goal assembly 1000, such as the backboard 1008, coupled to a wall or a ceiling, or coupled to a vertical arm of the ball stopping wall, such as one supported by a stand or base.

In some instances, the basketball stopping wall 100 may have a compact, stored configuration that is portable. A portable ball stopping wall may be desired so as to make the space below the backboard 1008 available for use and/or so as to allow the ball stopping wall to be taken with the player to another location for use and/or storage. Various arrangements of a portable ball stopping wall 100 are possible. For example, the ball stopping wall 100 may be collapsed into an arrangement with the arms substantially parallel to one another and with the wall portions 120, 122, 124, and/or 126 gathered and secured to the arms. In some embodiments, the ball stopping wall is detachably coupled to the basketball goal. Additionally, portions of the ball stopping wall 100 may be compactable. For example, one or more of the arms may have telescoping segments that, when in a compact arrangement, decrease the overall length of the arm.

Figure 2:
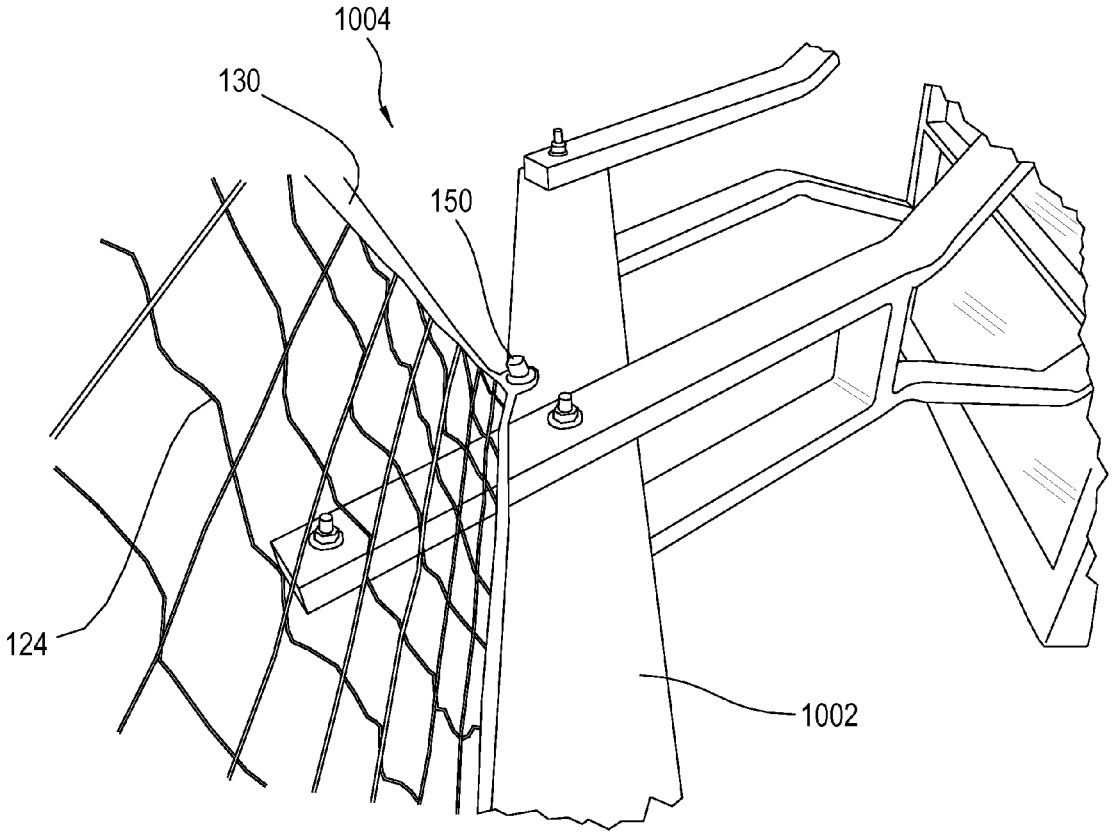
FIG. 2 is a partial view of one embodiment of the present disclosure and of a basketball goal assembly.

FIG. 2 illustrates a partial view of one embodiment of the present disclosure and of a basketball goal assembly 1000. In some instances, a fastening member 150 couples the upper portion of the wall and/or the perimeter member 130 to the basketball goal assembly 1000. The fastening member 150 may be any member known to a person of reasonable skill in the art capable of fastening a portion of the basketball stopping wall 100 to the post 1002. To name a few non-limiting examples, the fastening member 150 may be a bolt and nut, a tie strap, a hook and grommet, a hook and loop connector, and/or a detachable snap.

Figure 3:
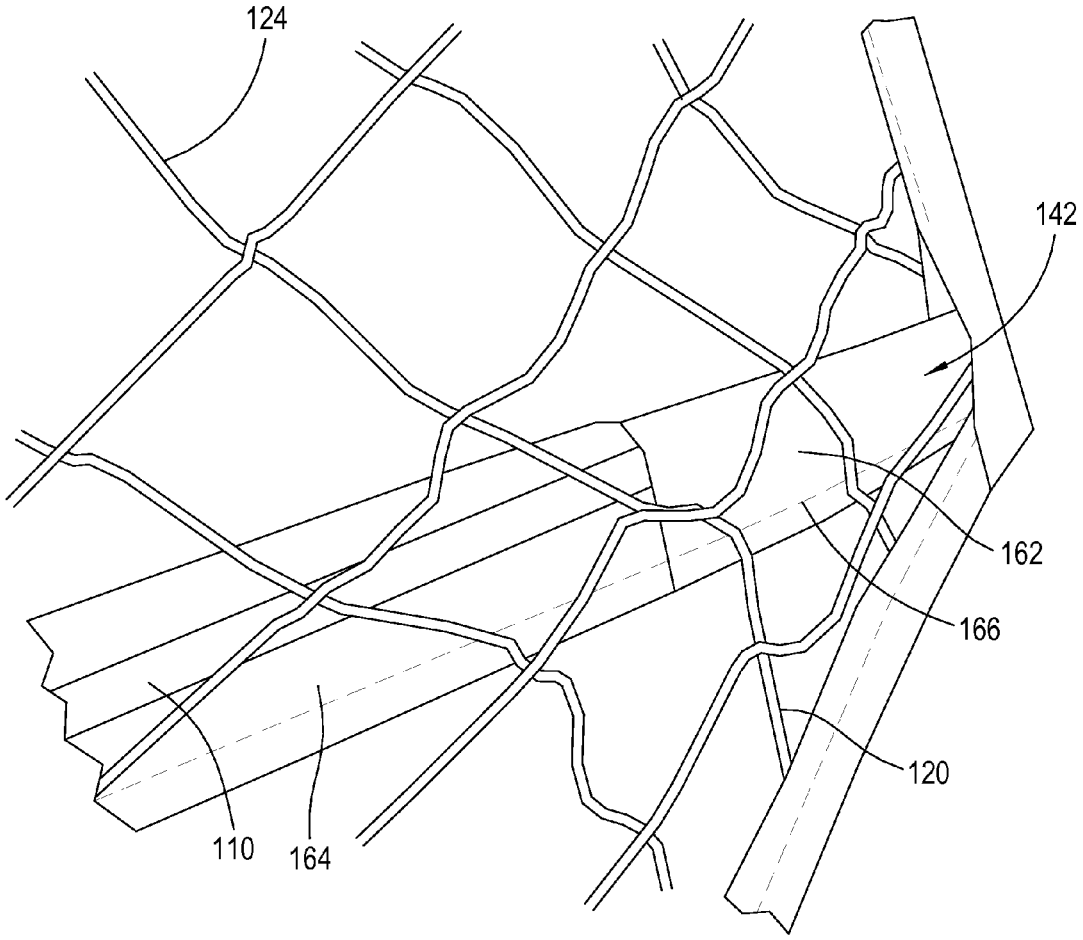
FIG. 3 is a partial, back view of one embodiment of the present disclosure.

FIG. 3 illustrates a partial view of one embodiment of the wall, such as inner wall portion 124 and outer wall portion 120, from the backside of the basketball stopping wall 100. In some instances, the intermediate arm 110 has an end, such as outer end 142, coupled to the wall and arranged to spread the net into an open arrangement. In some arrangements, the ends of the intermediate arms are received in opposing end pockets that are secured to wall portions. For example, the outer end 142 of the intermediate arm 110 may be positioned within a pocket 162 that is coupled to an upper portion of the wall. Similarly, the base end 114 of the intermediate arm 110 may be in a pocket coupled to a lower portion of the wall so that the arm length pushes ends 142 and 114 to spread the wall.

In some instances, the intermediate arm 110 is at least partially covered along a portion that is intermediate the outer end 142 and the base end 114. For example, the intermediate arm 110 may have a cover 164 and/or a sleeve that covers portions of the intermediate arm 110. The sleeve and/or cover 164 can help provide protection to the intermediate arm 110 and/or aid in the alignment of the intermediate arm 110 with the wall and spreading of the wall. In some embodiments, the arm and/or sleeve may be coupled to the wall at one or more locations between the two ends 142 and 114 of the intermediate arm 110.

Various arrangements for coupling the intermediate arm 110 to the wall are possible. For example, in ball stopping wall 100 arrangements that have a pocket 162, the wall, such as wall portions 120 and 124 may be coupled to the pocket 162 by stitching along a seam 166. Similarly, in the embodiments having a sleeve and/or cover 164 along a portion of the intermediate arm 110, the wall may be coupled to the sleeve and/or cover 164 by stitching. Alternatively, or in addition, the intermediate arm 110 may be coupled to the wall by connecting members such as zip tie 168 (shown in FIG. 5) and/or the intermediate arm 110 may be threaded through openings in the wall, such as net and/or mesh-like portions of the wall. For example, the wall may be coupled to the intermediate arm 110 with a tie such as a zip tie, a cable tie, laces, or a strap, to name a few non-limiting examples. As will be appreciated by one of ordinary skill in the art, the means for coupling the intermediate arm 110 to the wall as described above may also be used to couple any of the other arms to the wall.

Figure 4:
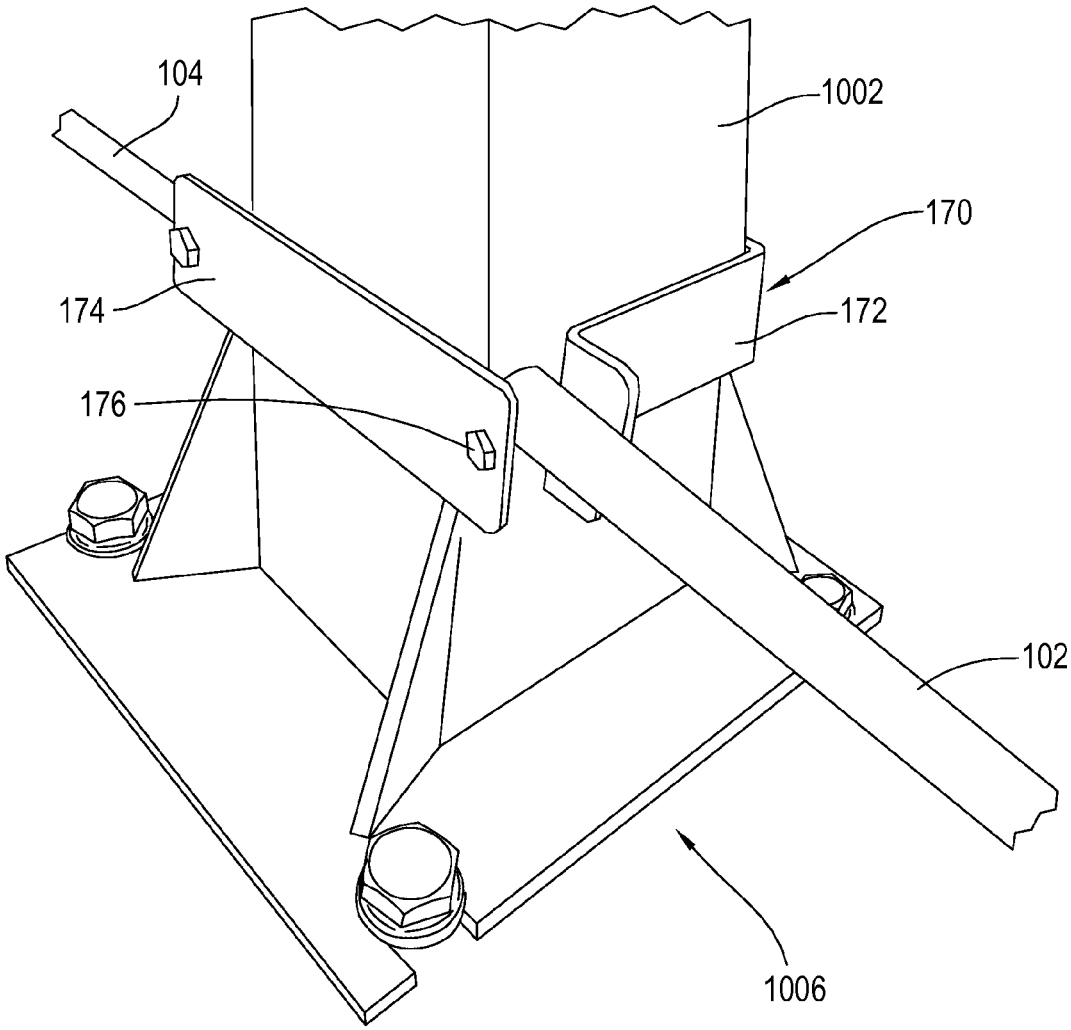
FIG. 4 is a partial, perspective view of one embodiment of the present disclosure and of a basketball goal assembly.

FIG. 4 illustrates a perspective view of the bottom end 1006 of the post 1002 of the basketball goal assembly 1000. The wall portions and intermediate arms are not shown for ease of illustration. In the embodiments in which the base arms 102 and 104 are coupled to the post 1002, the bottom end 1006 of post 1002 may have a lower bracket 170 comprising a front portion 172 and a back portion 174 so as to mount the base arms 102 and/or 104 to the post 1002. The front portion 172 of the lower bracket 170 is coupled to the back portion 174 by a coupling member 176. The coupling member 176 may be any device capable of coupling the front portion 172 to the back portion 174 as will be apparent to one of ordinary skill in the art, such as a screw, a bolt, and/or a clamp, to name a few non-limiting examples.

In some embodiments, the base arms 102 and/or 104 are pivotably coupled to the post 1002 via bracket 170. For example, the coupling member 176 may extend through a portion of the base arm 102 and/or 104 and serve as an axle to allow the base arm 102 and/or 104 to vertically rotate. The coupling member 176 may be accompanied by the appropriate fasteners, such as washers, bushings, and/or bearings. Alternatively, the base arm 102 and/or 104 may be coupled to a portion of the lower bracket 170 and/or the post 1002 by an additional member, such as a hinge.

In some embodiments, the ball-diverting wall 100 does not have a lower bracket 170. As will be appreciated by one of ordinary skill in the art, a number of different variations are capable of coupling the base arms 102 and/or 104 to the post 1002. For example, the base arms 102 and/or 104 may be pivotably coupled to the post 1002 by a pin that passes through the base arm 102 and/or 104 and the post 1002. Alternatively, the base arms 102 and/or 104 may have a flexible resilient member that passes through holes in the base arms 102 and/or 104 and wraps around the post 1002, such as a cord, wire, or string, to name a few non-limiting examples.

Figure 5:
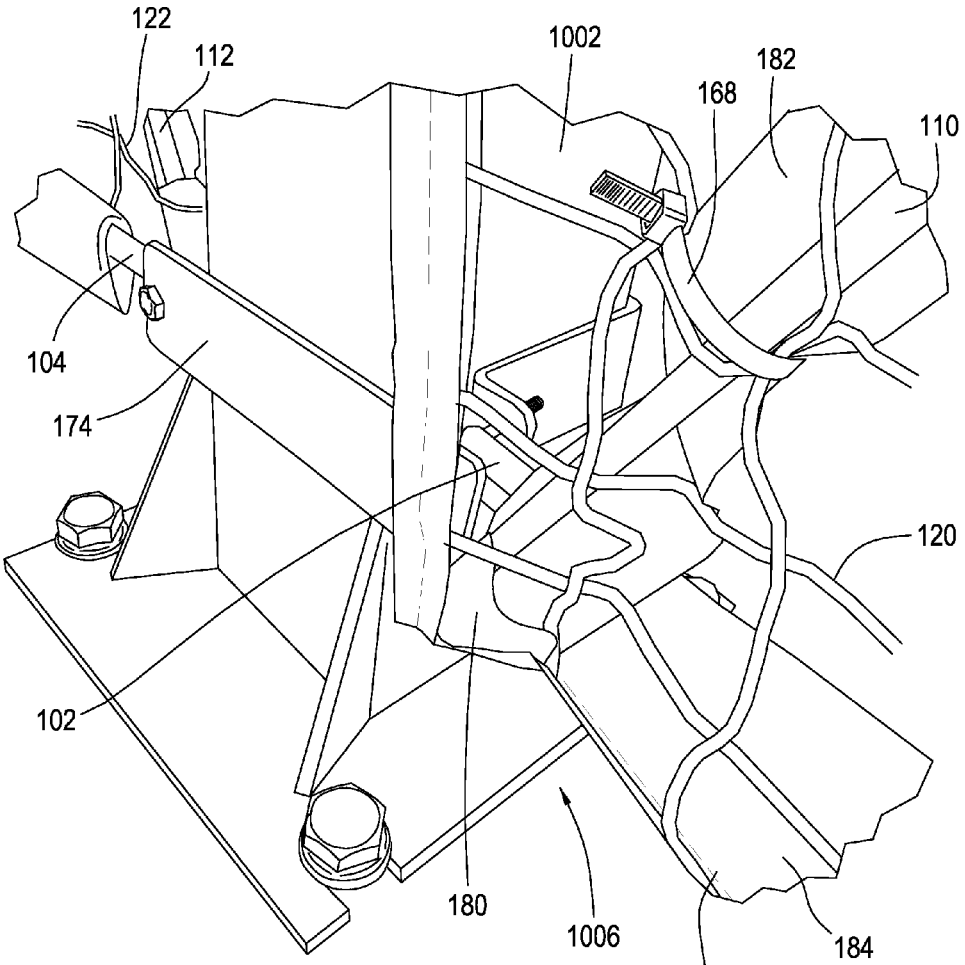
FIG. 5 is a partial, perspective view of one embodiment of the present disclosure and of a basketball goal assembly.

FIG. 5 illustrates a perspective view of the bottom end 1006 of the post 1002. As can be seen, the base end 116 of the intermediate arm 112 extends into a pocket 180. Pocket 180 is adjacent the pivot axle but is not attached. This enables the intermediate arm 112 to have a free or floating base end 116. However, it is contemplated that the base end 116 of intermediate arm 112 can be pivotably coupled to the bottom end 1006 of the post 1002. For example, the coupling member 176 illustrated and described with respect to FIG. 4 may also pass through base end 116 of intermediate arm 112. FIG. 5 also illustrates an optional covers or sleeves 182 and/or 184 extending over the intermediate arm 110 and base arm 102. In some instances, the outer wall 120 is coupled to the base arm 104 by capturing a portion of the outer wall 120 within the cover 184 and sewing the cover 184 together along seam 186.

Figure 6:
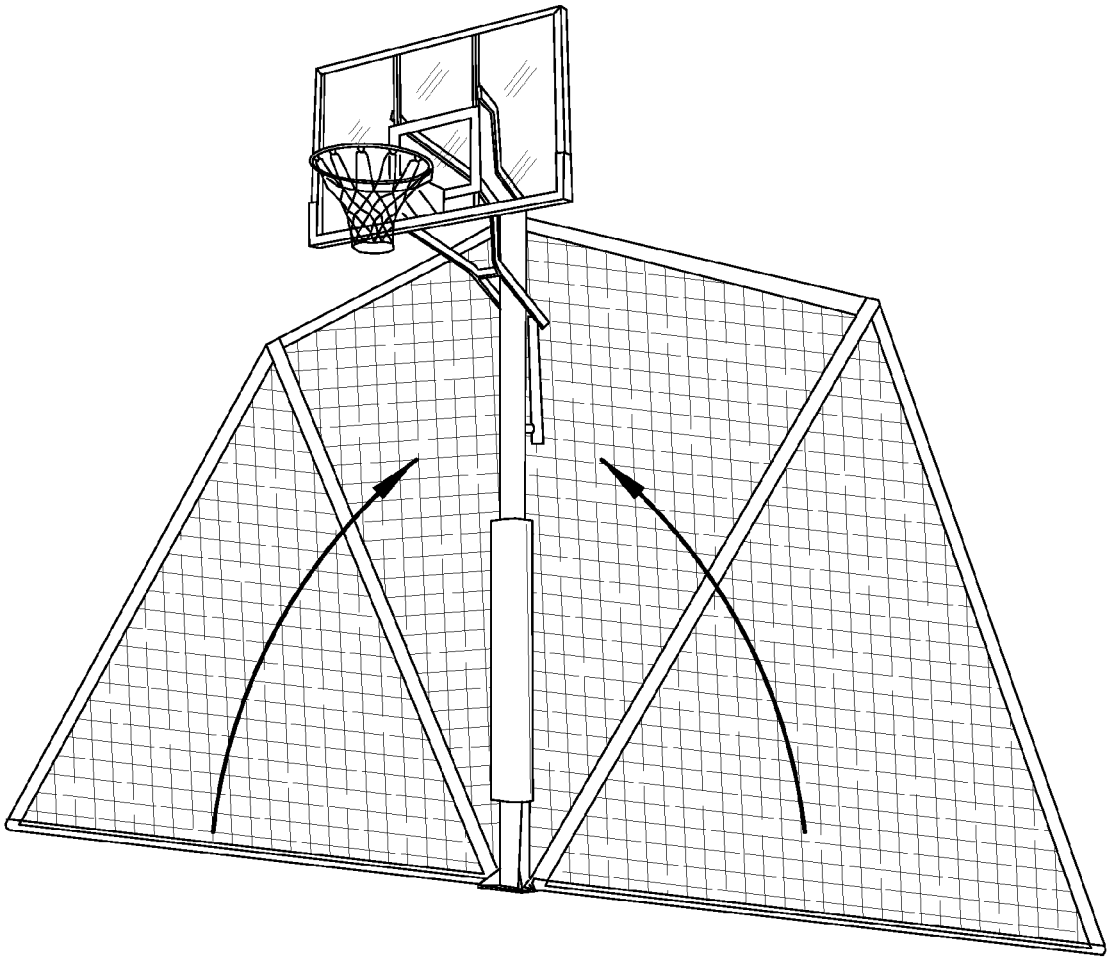
FIG. 6 is a perspective view of one embodiment of the present disclosure.
Figure 7:
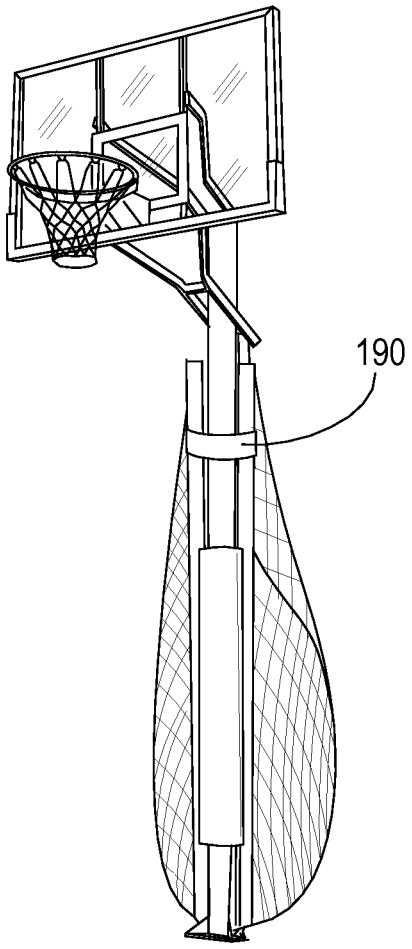
FIG. 7 is a perspective view of one embodiment of the present disclosure.

FIGS. 6 and 7 illustrate one operation of the basketball stopping wall 100. FIG. 6 illustrates a spread-open, in-use configuration, while FIG. 7 illustrates the basketball stopping wall 100 in a gathered, stored configuration. Portions of the basketball stopping wall 100 are pivotably maneuverable around a point on or near the bottom end 1006 of the post 1002 so that when an operator desires to store the basketball stopping wall 100 for periods of nonuse, the operator may pivot the base arms 102 and 104 vertically into a position alongside the post 1002. Similarly, in some embodiments, the intermediate arms 110 and 112 also are moved into position alongside the post 1002. The basketball stopping wall 100 is collapsed and gathered around the base arms 102 and 104 and/or intermediate arms 110 and 112 for storage and may then be retained in its upright, stored position, for example by using a strap 190 positioned around the middle or adjacent to the outer/upper ends of the base arms 102 and 104 and/or the intermediate arms 110 and 112.

Figure 8:
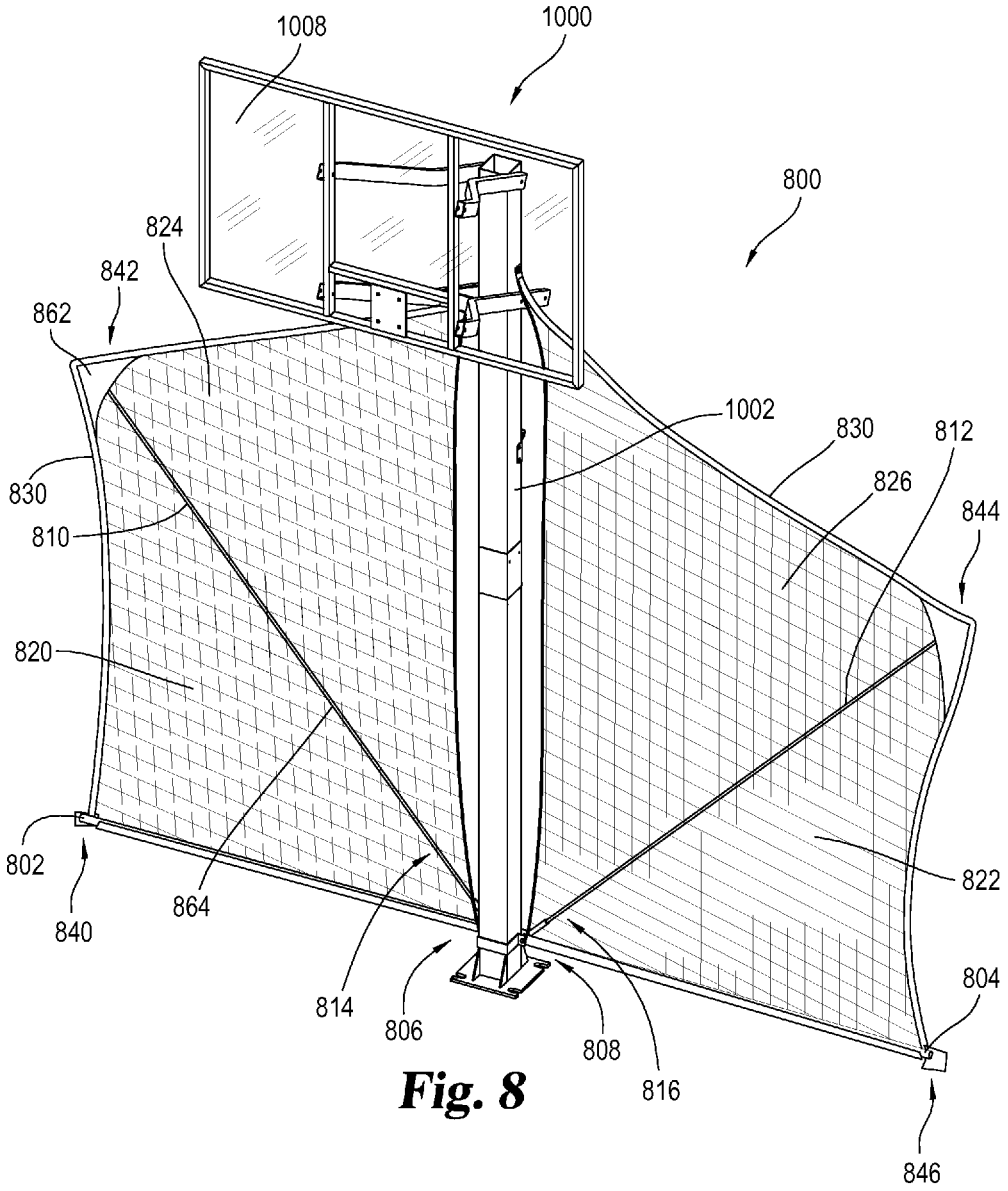
FIG. 8 is a perspective view of one embodiment of the present disclosure.

Another exemplary embodiment of a basketball stopping wall is illustrated in FIG. 8. Similar to the embodiments described above, basketball stopping wall 800 has wall portions that are spread open by a pair of base arms 802, 804 and intermediate arms 810, 812. Similar to the base arms 102 and 104 described above, base arms 802 and 804 can be arranged so that, when deployed, they extend and/or spread wall portions in any number of directions. Similarly, portions of the flexible wall can be spread and angled in a number of directions, such as those described in the previously discussed embodiments.

Base ends 806 and 808 of the base arms 802 and 804 are pivotably coupled to the bottom end 1006 of the post 1002 so as to allow the base arms 802 and 804 to be vertically pivoted and the wall portions to be collapsed and/or gathered adjacent the post 1002 at the same time. Such an arrangement decreases the amount of space the basketball stopping wall 800 occupies during periods of nonuse and thus allows for one to more easily maneuver around the basketball goal assembly 1000. Base arms 802 and 804 may be pivotably coupled in an arrangement capable of rotation in other directions, and, in some instances, is pivotably coupled to a base member positioned on a supporting surface.

Similar to intermediate arms 110 and 112 described above, intermediate arms 810 and 812 spread portions of the wall between the base arms 802 and 804 and the post 1002 and may extend in any number of directions. In many instances, intermediate arms 810 and 812 have base ends 814 and 816 positioned at and/or near the base 1006 of the basketball goal assembly 1000 and extend from the base ends 814 and 816 in an upward direction away from the post 1002. Preferably, the ends of the intermediate arms 810 and 812 are coupled to the wall so as to spread the wall along the length of the intermediate arm.

In comparison to the embodiment illustrated in FIG. 1, intermediate arms 810 and 812 of the embodiment illustrated in FIG. 8 are longer than base arms 802 and 804 whereas intermediate arms 110 and 112 of FIG. 1 are illustrated as having substantially the same length as base arms 102 and 104. While it should be appreciated that the intermediate arms and base arms of any of the embodiments disclosed herein, such as those illustrated in FIGS. 1 and 8, can have any relative length, there may be instances in which certain lengths or relative lengths between the arms are desirable. For instance, it may be preferred that the intermediate arms are longer than the base arms so that the wall portions, when in an open configuration, form a generally rectangular shape. Additionally, longer intermediate arms may spread more portions of the wall vertically and laterally without increasing the footprint of the basketball stopping wall 800, i.e., the area of the supporting surface that a vertical projection of the wall 800 occupies. Advantageously, having portions of the wall spread to a more elevated and/or lateral position can aid in stopping an overshot basketball from traveling behind the basketball goal. Similarly, as will be appreciated by one of ordinary skill in the art, the base arms 802 and 804 and intermediate arms 810 and 812 may be various cross-sectional shapes and sizes and may be formed from different materials.

Like the embodiments illustrated and described above, the wall of the ball stopping wall 800 may have multiple portions and may be made of a single wall piece or of multiple wall pieces. For example, the base arms 802 and 804 and intermediate arms 810 and 812 may spread outer wall portions 820 and 822 horizontally and vertically. In some instances, portions of the wall may be coupled to portions of the basketball goal assembly 1000, such as the post 1002 and/or the backboard 1008, and/or a vertical arms supported by a stand or base member.

One or more perimeter members 830 may extend along a perimeter of the wall portions 820, 822, 824, and/or 826. In some embodiments, the perimeter member 830 extends between one or more outer ends of arms, such as outer end 840 of base arm 802 and outer end 842 of intermediate arm 810 and/or outer end 844 of intermediate arm 812 and outer end 846 of base arm 804. Additionally, the one or more perimeter members 830 may be coupled to a portion of the basketball goal assembly 1000, such as the post 1002.

When in an open or spread, ball-diverting configuration, such as the one illustrated in FIG. 8, the basketball stopping wall 800 may form a substantially planer arrangement adjacent to and often slightly behind the backboard 1008. The base arms 802 and 804 spread the outer wall portions 820 and 822 and the perimeter member 830 horizontally away from the post 1002 and in a downward direction, such as by the weight of the base arms 802 and 804 pulling down on the outer wall portions 820 and 822 and the perimeter members 830. Additionally, the intermediate arms 810 and 812 spread the wall portions 820, 822, 824, and/or 826 along the length of the intermediate arms 810 and 812.

When in a compact, stored configuration, the base arms 802 and/or 804 and/or the intermediate arms 810 and/or 812 can be positioned vertically, for example alongside the post 1002 of the basketball goal assembly 1000. Similarly, the wall portions 820, 822, 824, and/or 826 are gathered or collapsed to be positioned adjacent to the base arms 802 and 804 and/or intermediate arms 810 and 812. Like the embodiments described above, the base arms 802 and/or 804, the intermediate arms 810 and/or 812, and/or wall portions 820, 822, 824, and/or 826 may be secured to one another and/or a portion of the basketball goal assembly 1000 by any appropriate fastener apparent to one of ordinary skill in the art.

Figure 9:
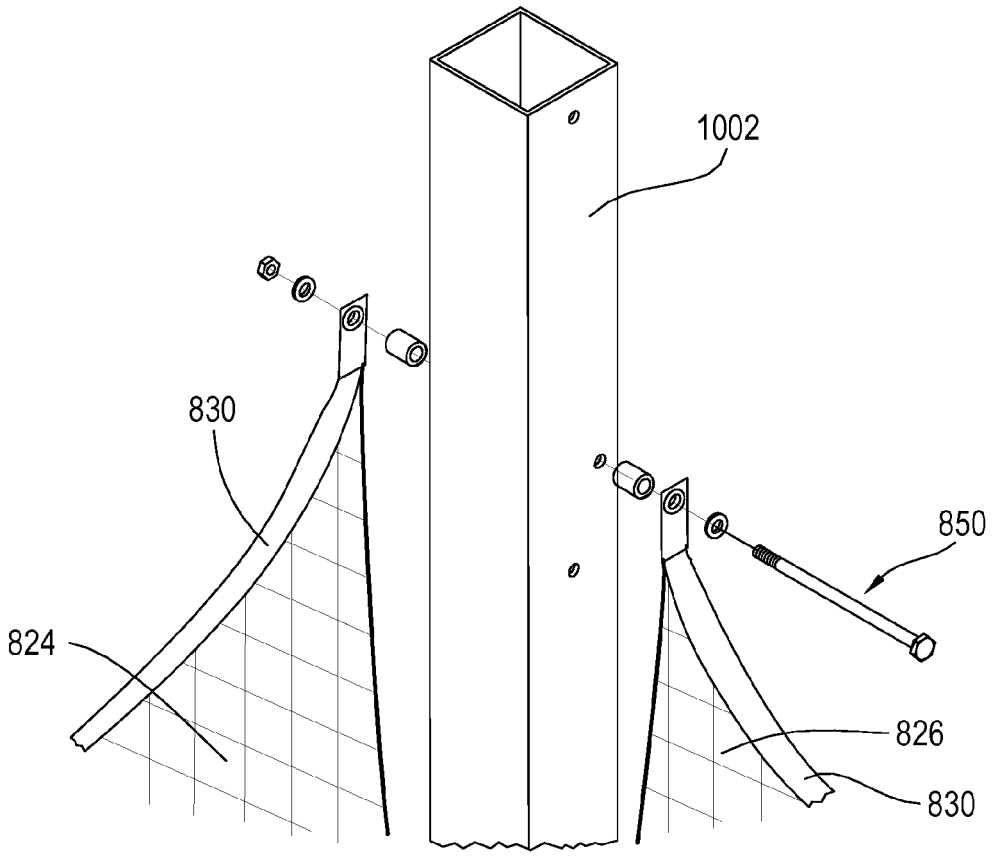
FIG. 9 is a partially exploded perspective view of a top portion of one embodiment of the present disclosure and of a basketball goal assembly.

FIG. 9 illustrates an exemplary arrangement for attaching wall portions to a post 1002. Similar to the embodiments discussed above, a fastening member 850 couples the upper portion of the wall and/or the perimeter member 830 to the basketball goal assembly 1000, and the fastening member 850 may be any member known to a person of reasonable skill in the art capable of fastening a portion of the basketball stopping wall 800 to the post 1002.

In some instances, an existing portion of the basketball goal assembly 1000 is used as the fastening member 850 to secure portion of the basketball stopping wall 800 to the basketball goal assembly 1000. For example, some basketball goal assemblies 1000 that have an adjustable height backboard and rim may have one or more safety stops, such as a safety stop bolt, that limits the travel of the adjustable portion of the backboard and rim. In some aspects, the safety stops, such as the safety stop bolts, may be used to secure a portion of the basketball stopping wall 800 to the basketball goal assembly 1000.

Returning to FIG. 8, the ends of the intermediate arm 810, such as outer end 842, are coupled to the wall and arranged to spread the wall into an open arrangement. For example, the outer end 842 of the intermediate arm 810 may be positioned within a pocket 862 that is coupled to an upper portion of the wall, such as wall portion 824. Similarly, the base end 814 of the intermediate arm 810 may be received in a pocket coupled to a lower portion of the wall so that the arm length pushes ends 842 and 814 to spread the wall. Alternatively or additionally, intermediate arm 810 may have a cover 864 and/or a sleeve that covers portions of the intermediate arm 810 and, in some embodiments, is coupled to the wall at one or more locations between the two ends 842 and 814 of the intermediate arm 810.

Figure 10:
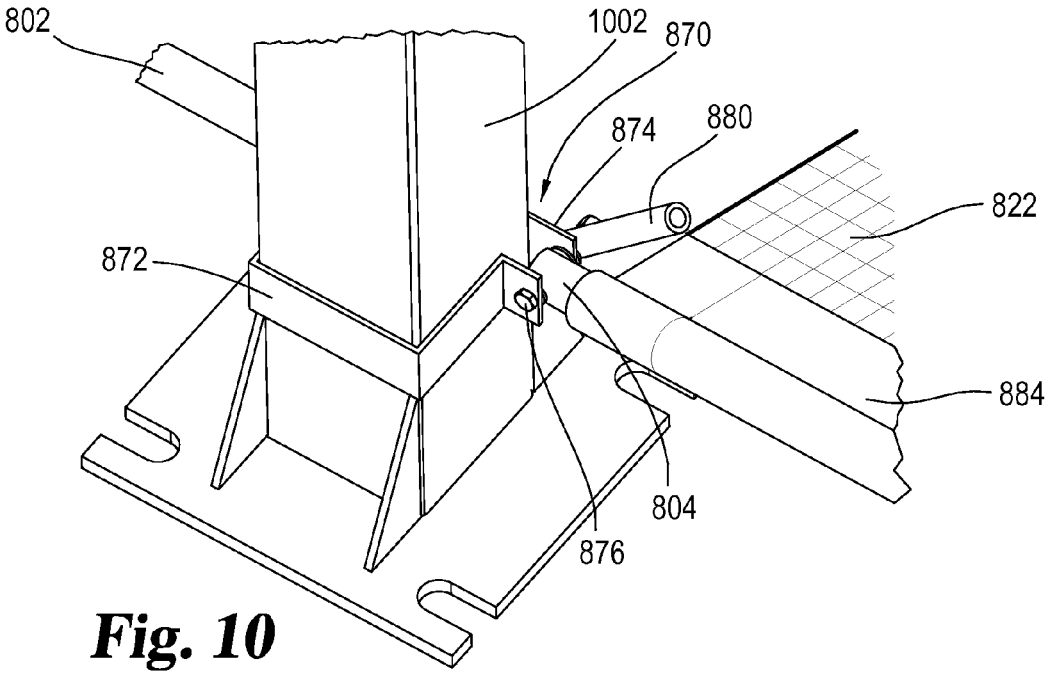
FIG. 10 is a partial, perspective view of one embodiment of the present disclosure and of a basketball goal assembly.
Figure 11:
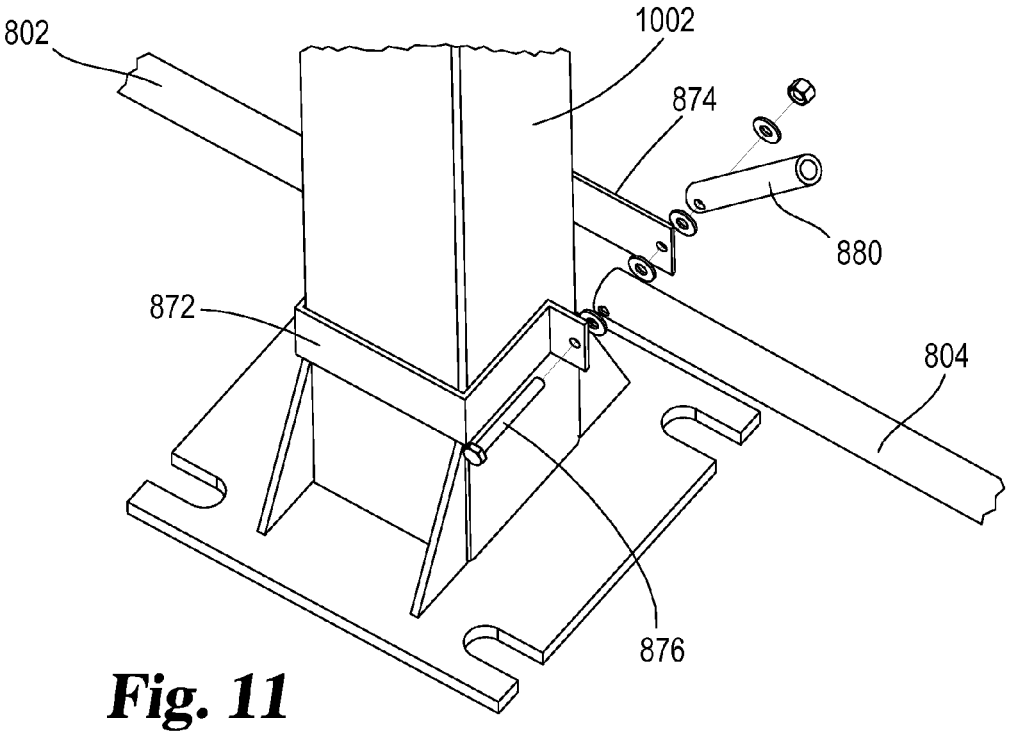
FIG. 11 is a partially exploded perspective view of a bottom portion of one embodiment of the present disclosure and of a basketball goal assembly.

FIGS. 10 and 11 illustrate a perspective view of the bottom end 1006 of the post 1002 of the basketball goal assembly 1000. For ease of illustration, the intermediate arms are not shown, and the wall portion is not shown in FIG. 11. In the embodiments in which the base arms 802 and 804 are coupled to the post 1002, a lower bracket 870 comprising a front portion 872 and a back portion 874 may be connected to the bottom end 1006 of post 1002 so as to mount the base arms 802 and/or 804 to the post 1002. The front portion 872 of the lower bracket 870 is coupled to the back portion 874 by one or more coupling members 876. The coupling member 876 may be any device capable of coupling the front portion 872 to the back portion 874 as will be apparent to one of ordinary skill in the art, such as a screw, a bolt, and/or a clamp, to name a few non-limiting examples.

The base arms 802 and/or 804 are pivotably coupled to the post 1002 via bracket 870. For example, the coupling member 876 may extend through a portion of the base arm 802 and/or 804 and serve as an axle to allow the base arm 802 and/or 804 to vertically rotate. Alternatively, the base arm 802 and/or 804 may be coupled to a portion of the lower bracket 870 and/or the post 1002 by an additional member, such as a hinge.

In some instances, a base end of an intermediate arm is coupled to the post 1002 and/or a base arm. For example, as illustrated in FIGS. 10 and 11, a pivot tube 880 is pivotably coupled to bracket 870 and is arranged to be inserted into base end 816 of intermediate arm 812 or receive base end 816 into the pivot tube 880 so as to pivotably couple the intermediate arm 812 to the basketball goal assembly 1000. Alternatively, intermediate arm 812 could be directly pivotably coupled to bracket 870, such as by having coupling member 876 pass through an aperture in base end 816 of intermediate arm 812. As illustrated, pivot tube 880 may share a common pivot axis with base arm 804, such as coupling member 876. Advantageously, the intermediate arms and base arms are arranged to pivot individually and separately from one another. This can allow an operator to configure individual wall portions between an open and a gathered configuration. FIG. 10 also illustrates a sleeve 884 extending over the base arm 804 that can be used to couple outer wall 822 to the base arm 804, such as by securing a portion of the outer wall 822 to sleeve 884 and sliding sleeve over base arm 804.

Figure 12:
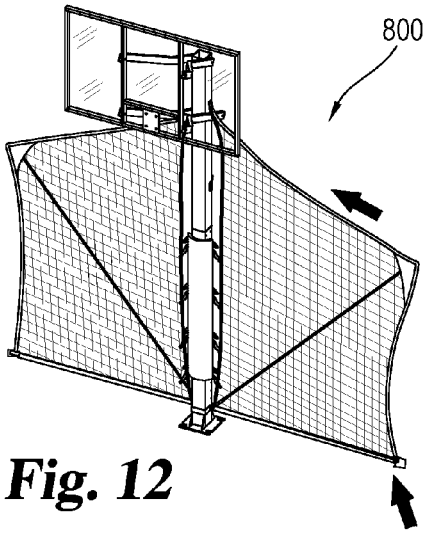
FIG. 12 is a perspective view of one embodiment of the present disclosure in an open configuration.
Figure 13:
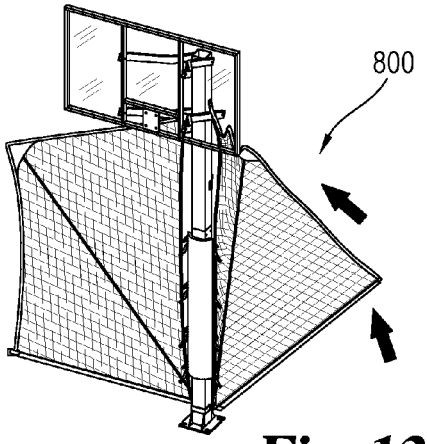
FIG. 13 is a perspective view of one embodiment of the present disclosure.
Figure 14:
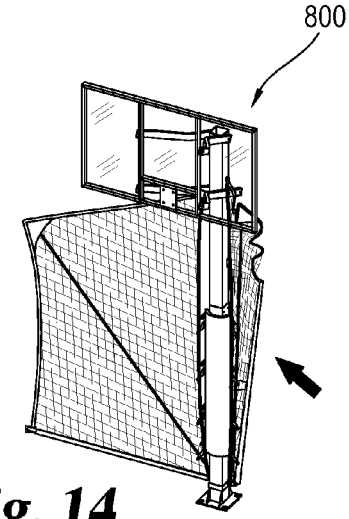
FIG. 14 is a perspective view of one embodiment of the present disclosure in a partially closed configuration.

FIGS. 12, 13, and 14 illustrate one operation of the basketball stopping wall 800. FIG. 12 illustrates a spread-open, in-use configuration, while FIG. 14 illustrates the portions of the basketball stopping wall 800 in a gathered, stored configuration. As discussed above, portions of the basketball stopping wall 800 are pivotably maneuverable around a point on or near the bottom end 1006 of the post 1002 so that when an operator desires to store the basketball stopping wall 800 for periods of nonuse, the operator may pivot the base arms 802 and 804 vertically into a position alongside the post 1002. Similarly, the intermediate arms 810 and 812 also are movable into a position alongside the post 1002. Once the basketball stopping wall 800 is collapsed and gathered around post 1002 by the base arms 802 and 804 and/or intermediate arms 810 and 812, the basketball stopping wall 800 may then be retained in its upright, stored position.

As illustrated in FIGS. 12-14, portions of the basketball stopping wall 800, such as left and right sides, may be moved individually, or portions of the basketball stopping wall 800 may be collapsed simultaneously. In many instances, the basketball stopping wall 800 may be collapsed by lifting one of the base arms in an upward direction towards an adjacent intermediate arm, then rotating both the base and intermediate arm into position adjacent to the post 1002 of the basketball goal 1000. Alternatively, one may begin collapsing the wall 800 by rotating an intermediate arm towards the post 1002, causing a connected base arm to be lifted upwards, and then rotating the base arm towards the post 1002. One may also collapse or gather the basketball stopping wall 800 by grasping and pulling on portions of the wall, so as to move one or more of the intermediate arms and/or base arms into a gathered configuration.

Figure 15:
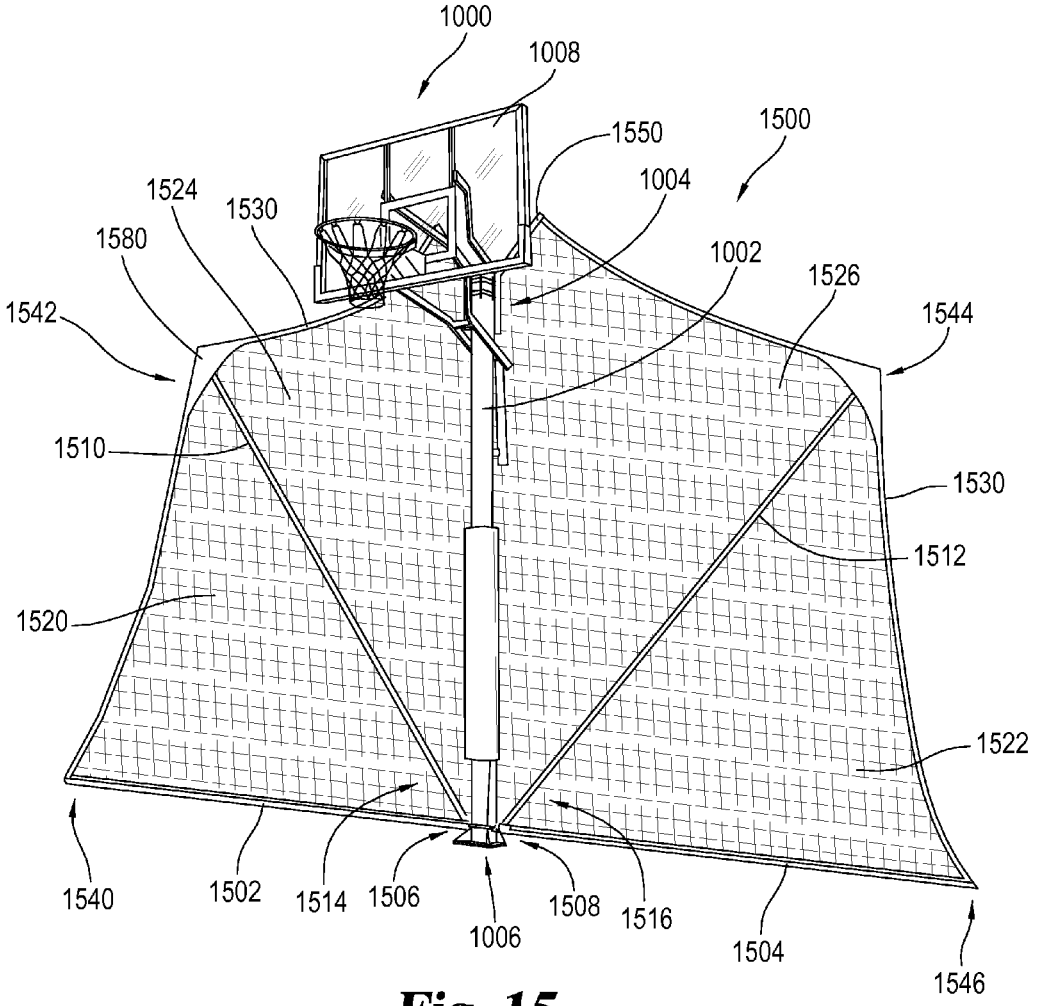
FIG. 15 is a perspective view of one embodiment of the present disclosure.

Another exemplary embodiment of a ball stopping wall is illustrated in FIG. 15. Similar to the embodiments described above, basketball stopping wall 1500 has wall portions that are spread open by a pair of base arms 1502 and 1504 and intermediate arms 1510 and 1512. These base arms 1502 and 1504 and intermediate arms 1510 and 1512 may be constructed and/or arranged similar to those described in the embodiments above and may be configured to operate in a similar fashion. For example, the base arms 1502 and 1504 and intermediate arms 1510 and 1512 may base ends 1506, 1508, 1514, and 1516 (corresponding with base ends 806, 808, 814, and 816 described above) pivotably coupled to a bottom end region of the post 1002 and may be arranged to extend in any number of directions. Similarly, the flexible wall of basketball stopping wall 1500 can be similar to that described in any of the above embodiments.

Figure 16:
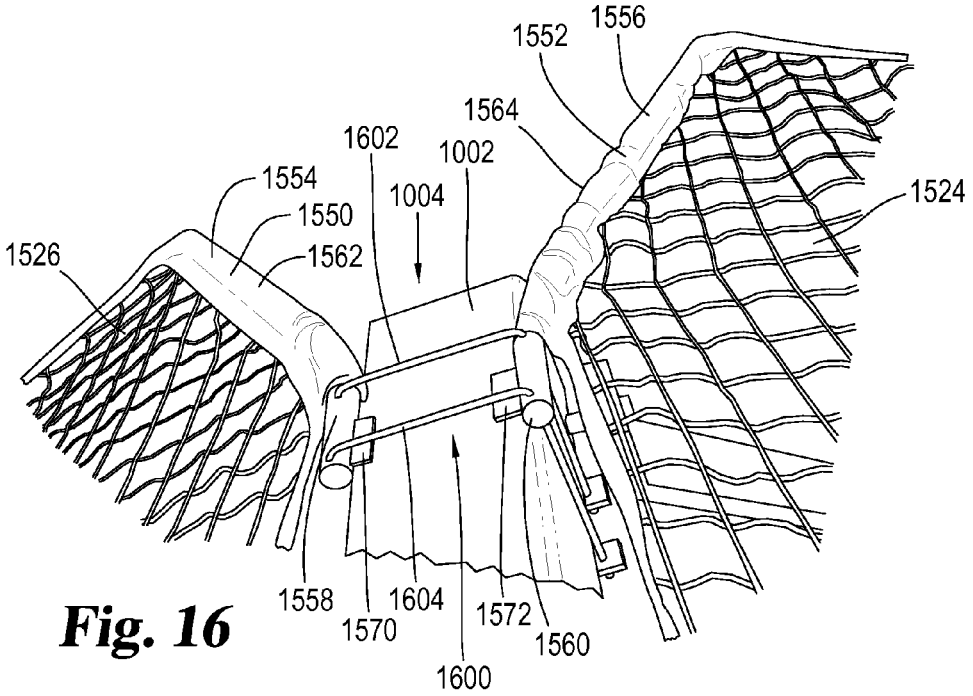
FIG. 16 is a partial, perspective view of the back of one embodiment of the present disclosure.

In addition to any of the features or embodiments described above, basketball stopping wall 1500 has upper spreading arms 1550 and 1552 (illustrated in FIG. 16). Upper spreading arms 1550 and 1552 aid in spreading portions of the wall 1500 in an upward direction behind the backboard 1008 of the basketball goal assembly 1000. In many instances, upper spreading arms 1550 and 1552 spread portions of the wall 1500 above the top end of the post 1002. In some instances, upper spreading arms 1550 and 1552 are coupled to the top end 1004 of post 1002 and extend upwardly and laterally away from the post 1002.

The wall of the ball stopping wall 1500 may have multiple portions and may be made of a single wall piece or of multiple wall pieces. For example, as illustrated in FIG. 15, the wall may have two wall portions, one for each half of the ball stopping wall 1500. As mentioned above, the base arms 1502 and 1504, intermediate arms 1510 and 1512, and upper spreading arms 1550 and 1552 spread portions of the wall. For example, the base arms 1502 and 1504 and intermediate arms 1510 and 1512 may spread outer wall portions 1520 and 1522 horizontally and vertically. Additionally, intermediate arms 1510 and 1512 and upper spreading arms 1550 and 1552 can spread wall portions 1524 and 1526 horizontally and vertically. Additionally, similar to the embodiments described above, the basketball stopping wall may comprise one or more perimeter members 1530 that extend along a perimeter of the wall portions 1520, 1522, 1524, and/or 1526 and aid in spreading one or more wall portions away from the basketball goal 1000.

Figure 17:
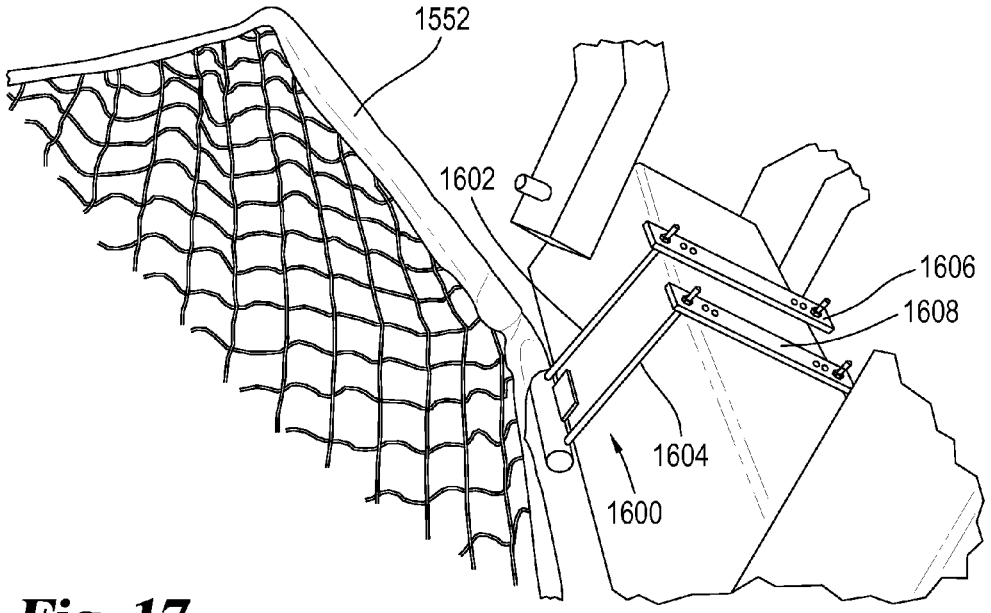
FIG. 17 is a partial, perspective view of the front of one embodiment of the present disclosure.

FIGS. 16 and 17 illustrate one embodiment of the present disclosure and of a basketball goal assembly 1000. Upper spreading arms 1550 and 1552 each have an upper portion 1554 or 1556 and a lower portion 1558 or 1560. Upper portions 1554 and 1556 extend above the top end 1004 of post 1002 and are coupled to wall portions 1524 and 1526, such as by sleeves 1562 and 1564. In some instances, upper portions 1554 and 1556 are bent relative to their respective lower portions 1558 and 1560. For example, upper portion 1554 of upper spreading arm 1550 may bend away from the longitudinal axis of post 1002 as it extends upwardly away from the top end 1004 of post 1002.

Lower portions 1558 and 1560 can be coupled to the top end 1004 of post 1002 by any number of means, as will be apparent to one or ordinary skill in the art. As illustrated in FIGS. 15-17, lower portions 1558 and 1560 are coupled to post 1002 by an upper bracket assembly 1600 comprising an upper coupling member 1602, a lower coupling member 1604, an upper fastening plate 1606, and a lower fastening plate 1608. The upper and lower coupling members 1602 and/or 1604 can comprise a square U-bolt arranged to extend through the lower portions 1558 and 1560 and around a portion of the post 1002. The ends of the U-bolt are threaded and arranged to receive a threaded fastener, such as a nut. Accordingly, the upper and lower fastening plates 1606 and/or 1608 may define one or more holes or slots arranged to receive ends of the coupling member 1602 and/or 1604. When the ends of the coupling member are received in the holes or slots of the fastening plates 1606, 1608, one or more nuts may be threaded onto U-bolt so as to press the fastening plate 1606 or 1608 against the post 1002 and correspondingly squeeze a portion of the post 1002 between the fastening plate 1606 or 1608, the coupling member 1602 or 1604, and/or the lower portions 1558 or 1560.

In some instances, the upper spreading arms 1550 and 1552 may have one or more aligning members arranged to align the upper spreading arm 1550 and 1552 with the post 1002. For example, in FIG. 16, upper spreading arm 1550 comprises aligning member 1570 and upper spreading arm 1552 comprises aligning member 1572. Aligning members 1570 and 1572 are arranged to contact the back surface of the post 1002 so as to keep the upper spreading arms 1550 and 1552 from sliding along a coupling member 1602 or 1604 and/or moving out of a desired alignment with the post 1002. Aligning members 1570 and 1572 can comprise one or more plates or pieces of angle iron attached to the lower portions 1558 and 1560 of the upper spreading arms 1550 and 1552 and can be arranged to contact one or more surfaces of the post 1002.

Returning again to FIG. 15, outer portions 1540, 1542, 1544, and 1546 of the arms (corresponding to outer portions 840, 842, 844, and 846 described above) may be coupled to wall portions. For example, outer end 1542 of intermediate arm 1510 can be coupled to the wall and arranged to spread the net into an open arrangement. Similar to the previously described embodiments, outer end 1542 may be coupled to the wall in a number of ways. For example, the outer end 1542 of the intermediate arm 1510 may be positioned within a pocket 1580 that is coupled to an upper portion of the wall, such as wall portion 1524. Additionally, or alternatively, the intermediate arm 1510 may have a cover and/or a sleeve that covers portions of the intermediate arm 1510 so as to provide protection to the intermediate arm 1510 and/or aid in the alignment of the intermediate arm 1510 with the wall and spreading of the wall.

Figure 18:
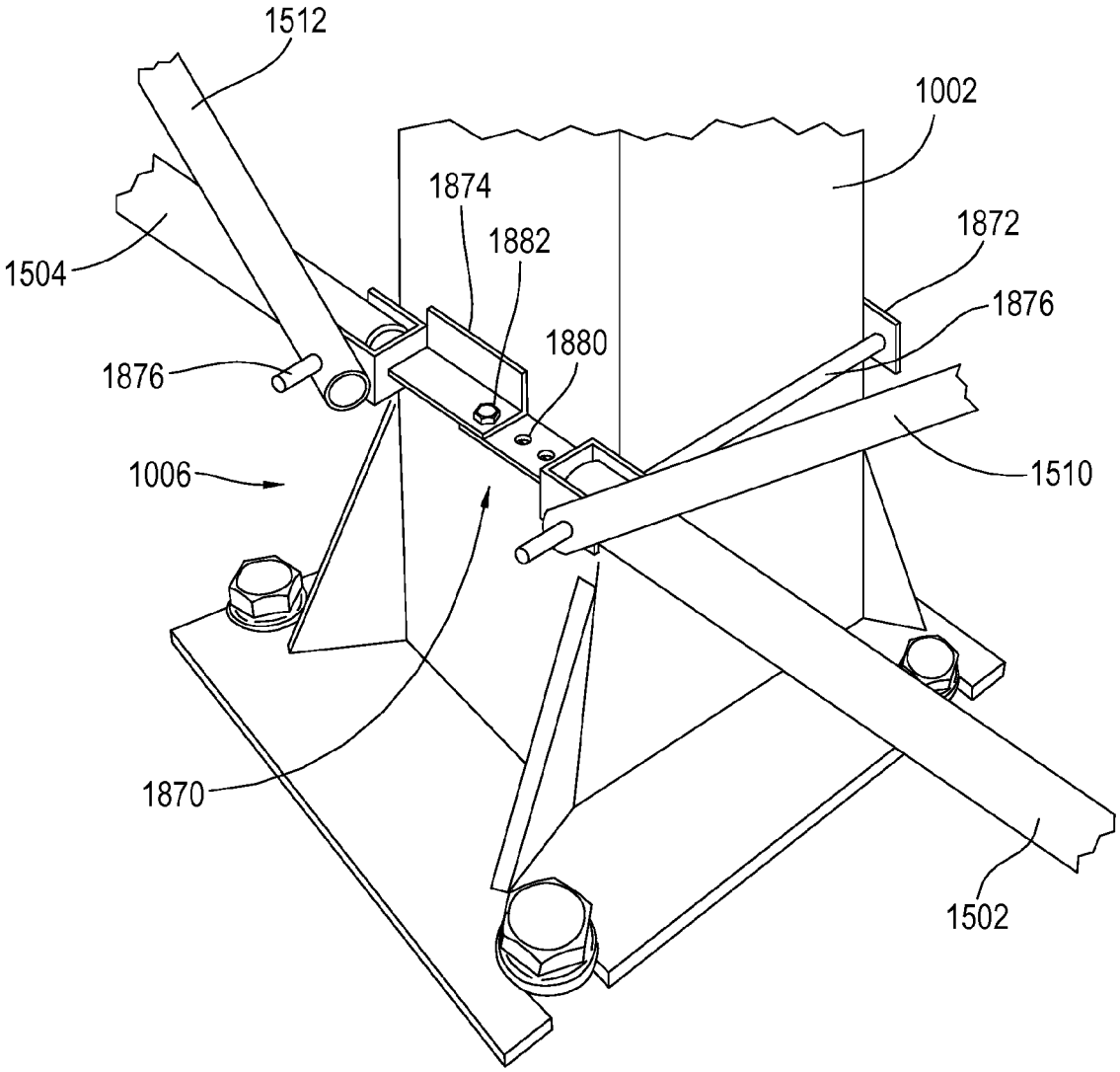
FIG. 18 is a partial, perspective view of the back of one embodiment of the present disclosure and of a basketball goal assembly.

FIG. 18 illustrates one embodiment for attaching portions of a basketball stopping wall to the bottom end 1006 of the post 1002. The embodiment can comprise a lower bracket 1870 having a front portion 1872 and a back portion 1874. Front and back portions 1872 and 1874 are coupled to one another by one or more coupling members such as a pin or bolt 1876 and are arranged to pivotably couple one or more arms, such as base arms 1502, 1504 and/or intermediate arms 1510, 1512, to post 1002. However, as will be apparent to those of skill in the art, the coupling members 1876 may be any device capable of coupling the front portion 1872 to the back portion 1874 as will be apparent to one of ordinary skill in the art, such as a screw, a bolt, and/or a clamp, to name a few non-limiting examples.

In some embodiments, lower bracket 1870 is adjustable to fit different sizes of posts. For example, back portion 1874 of lower bracket 1870 may define one or more openings 1880 through which a securing member, such as bolt 1882, may extend. Advantageously, when attaching the basketball stopping wall to a post 1002, an operator may choose the appropriate opening 1880 through which to extend the securing member, e.g., bolt 1882, so as to secure the lower bracket 1870 firmly to the post 1002.

In some embodiments, the base arms of the basketball stopping wall, such as base arms 1502 and/or 1504, are pivotably coupled to the post 1002 via bracket 1870. For example, the coupling member 1876 may extend through a portion of the base arm 1502 and/or 1504 and serve as an axis about which base arm 1502 and/or base arm 1504 can rotate. In some instances, both an intermediate arm and a base arm to the post 1002 share a pivot axis. For example, coupling member 1876 may extend through portions of base arms 1502 and intermediate arm 1510. The coupling member 1876 may be accompanied by the appropriate fasteners, such as washers, bushings, and/or bearings. Alternatively, the base arm 1502 and/or 1504 may be coupled to a portion of the lower bracket 1870 and/or the post 1002 by an additional member, such as a hinge.

While at least one embodiment has been illustrated and described in detail in the drawings and foregoing description, the same is to be considered as illustrative and not restrictive in character, it being understood that the preferred embodiment has been shown and described and that all changes, equivalents, and modifications that come within the spirit of the inventions defined by following claims are desired to be protected. It will be evident from the specification that aspects or features discussed in one context or embodiment will be applicable in other contexts or embodiments. All publications, patents, and patent applications cited in this specification are herein incorporated by reference as if each individual publication, patent, or patent application were specifically and individually indicated to be incorporated by reference and set forth in its entirety herein.

The invention claimed is:

1. A method of using an apparatus for stopping an errantly shot basketball, comprising:

attaching an upper edge of a flexible wall of a net material to a top end region of a post of a basketball goal, the flexible wall comprising left and right wall portions, said wall portions defining left and right wall upper perimeter portions;

pivotally connecting a rigid left base arm to a bottom end region of the post, the left base arm having a length secured along a bottom edge of the left wall portion;

pivotally connecting a rigid right base arm to the bottom end region of the post, the right base arm having a length secured along a bottom edge of the right wall portion;

attaching a left intermediate arm to the left wall portion and a right intermediate arm to the right wall portion, wherein the left and right intermediate arms have base ends positioned at or near the bottom end region of the post and outer ends positioned at or near a periphery of the respective wall portion, and wherein the left and right intermediate arms extend diagonally and push the respective left and right wall upper perimeter portions radially away from the bottom end region of the post when the flexible wall is in a spread open configuration;

spreading the left and right wall portions of the flexible wall laterally away from the post to the spread open configuration to form a wall to stop an errantly shot basketball by pivoting the left and right base arms from a vertical configuration to a horizontal configuration wherein said left wall upper perimeter portion extends in an outward and downward direction away from the top end region of the post, and said right wall upper perimeter portion extends in an outward and downward direction away from the top end region of the post;

gathering the entirety of the flexible wall near the post by pivoting the left and right base arms from the horizontal configuration to the vertical configuration; and, storing the flexible wall and the left and right base arms in a gathered position adjacent the post;

wherein said left wall upper perimeter portion extends from the top end region of the post to the outer end of the left intermediate arm, and the right wall upper perimeter portion extends from the top end region of the post to the outer end of the right intermediate arm; and, wherein gathering the entirety of the flexible wall includes pivoting the left and right intermediate arms to a vertical configuration.

2. The method of claim 1, wherein:

the left and right intermediate arms are pivotally connected to the bottom end region of the post.

3. The method of claim 1, wherein:

the left and right intermediate arms are flexibly resilient along their length.

4. The method of claim 1, wherein:

in the horizontal configuration the left and right base arms are generally parallel to a supporting surface.

5. The method of claim 1, wherein:

the left and right base arms are positioned behind a backboard of the basketball goal.

6. The method of claim 1, wherein:

the post of the basketball goal enters a hole in the ground or is bolted to the ground.

7. A method of using an apparatus for stopping an errantly shot basketball, comprising:

positioning a base on the ground below a basketball goal;

pivotally connecting a rigid left base arm and a rigid right base arm to the base so that the left and right base arms are pivotable between a vertical configuration and a horizontal configuration;

attaching a bottom edge of a left wall portion of a flexible wall of a net material along the length of the left base arm;

attaching a bottom edge of a right wall portion of the flexible wall along the length of the right base arm;

attaching an upper portion of the flexible wall to an elevated portion of the basketball goal wherein said flexible wall defines left and right wall upper perimeter portions;

attaching a left intermediate arm to the left wall portion and a right intermediate arm to the right wall portion, wherein the left and right intermediate arms have base ends positioned at or near the base and outer ends positioned at or near a periphery of the respective wall portion, and wherein the left and right intermediate arms extend diagonally and push the respective wall portion radially away from the base when the flexible wall is spread in an open configuration, wherein said left wall upper perimeter portion extends from the basketball goal to the outer end of the left intermediate arm, and the right wall upper perimeter portion extends from the basketball goal to the outer end of the right intermediate arm;

rotating the left and right base arms to a horizontal configuration wherein the left and right base arms spread the left and right wall portions of the flexible wall laterally away from the base so as to spread the flexible wall portions into the open configuration behind a backboard of the basketball goal wherein said left wall upper perimeter portion extends in and outward and downward direction away from the basketball goal, and said right wall upper perimeter portion extends in an outward and downward direction away from the basketball goal; and, rotating the left and right base arms to the vertical configuration and gathering the entirety of the flexible wall above the base;

wherein gathering the entirety of the flexible wall includes pivoting the left and right intermediate arms to a vertical configuration.

8. The method of claim 7, wherein:

the left and right intermediate arms are pivotally connected to the base.

9. The method of claim 7, comprising:

selectively securing the base arms and wall in the vertical configuration for storage.

10. The method of claim 9, wherein:

in the horizontal configuration the wall portions are generally parallel to and offset rearward from the backboard of the basketball goal.

11. The method of claim 7, wherein:

attaching the bottom edge of the left wall portion to the left base arm includes sliding the left base arm into a left sleeve that extends along the bottom edge of the left wall portion; and attaching the bottom edge of the right wall portion to the right base arm includes sliding the right base arm into a right sleeve that extends along the bottom edge of the right wall portion.

12. The method of claim 7, wherein:

attaching the left intermediate arm to the left wall portion includes sliding the left intermediate arm into a left sleeve extending along and secured to the left wall portion; and attaching the right intermediate arm to the right wall portion includes sliding the right intermediate arm into a right sleeve extending along and secured to the right wall portion.

13. A method of operating an assembly for stopping an errantly shot basketball the assembly including a flexible wall of a net material having an upper portion secured to an elevated portion of a basketball goal and left and right wall portions, the left wall portion having a bottom edge secured along a length of a left base arm and the right wall portion having a bottom edge secured along a length of a right base arm, the left and right base arms pivotally connected to a bottom end region of the basketball goal, wherein the assembly includes a left intermediate arm secured to the left wall portion and a right intermediate arm secured to the right wall portion, wherein the left and right intermediate arms each have a base end, an outer end, and a length, and wherein the wall includes a left wall upper perimeter portion and a right wall upper perimeter portion, the method, comprising:

spreading the assembly attached to the basketball goal to a spread arrangement by pivoting the left and right base arms to a horizontal configuration so as to stop an errantly shot basketball, the left wall upper perimeter portion extending in an outward and downward direction away from the elevated portion of the basketball goal, and the right wall upper perimeter portion extending in an outward and downward direction away from the elevated portion of the basketball goal, wherein the left and right intermediate arms each spread the secured wall portion along the length of the intermediate arm when the assembly is in the spread arrangement; and, collapsing the assembly to a vertical configuration in which the entirety of the flexible wall, the left and right intermediate arms, and left and right base arms are gathered near a basketball post of the basketball goal by pivoting the left and right base arms to the vertical configuration.

14. The method of claim 13, wherein:

the base ends of the left and right intermediate arms are adjacent to a base of the basketball goal and the outer ends are adjacent a peripheral edge of the respective flexible wall portion.

15. The method of claim 13, wherein:

the flexible wall supports the outer ends of the left and right intermediate arms, holding the left and right intermediate arms in a diagonal configuration relative to the basketball goal when the assembly is in the spread arrangement.

16. The method of claim 13, comprising selectively securing the left and right base arms and the flexible wall in the gathered arrangement for storage.

17. The method of claim 13, wherein:

the left and right base arms are rigid along their length.

* * * * *